US005106057A

United States Patent [19]

Feller et al.

[11] Patent Number: 5,106,057

[45] Date of Patent: Apr. 21, 1992

[54] STAGE SET LIFT APPARATUS

[75] Inventors: Peter Feller, Palisades; John Kaes, New York, both of N.Y.

[73] Assignee: Feller Precision, Inc., Tappan, N.Y.

[21] Appl. No.: 528,134

[22] Filed: May 23, 1990

[51] Int. Cl.[5] ..... B66D 1/12; B66D 1/26

[52] U.S. Cl. ..... 254/334; 254/283; 254/292; 254/365

[58] Field of Search ..... 254/283, 286, 289, 290, 254/292, 330, 334, 336, 338, 362, 387, 365

[56] References Cited

U.S. PATENT DOCUMENTS

| | | | |
|---|---|---|---|
| 1,026,118 | 5/1912 | Pearson | 254/292 |
| 3,541,710 | 11/1970 | Sankey et al. | 254/290 X |
| 3,986,703 | 10/1976 | Brett et al. | 254/375 X |
| 4,134,177 | 1/1979 | Janson | 254/394 X |
| 4,497,470 | 2/1985 | Carter et al. | 254/330 X |
| 4,606,527 | 8/1986 | Ziller et al. | 254/336 |
| 4,662,628 | 5/1987 | Compagnone | 254/278 X |
| 4,719,811 | 1/1988 | Lang et al. | 254/338 X |

FOREIGN PATENT DOCUMENTS

| | | | |
|---|---|---|---|
| 864727 | of 1927 | Australia | 254/286 |
| 361395 | 4/1921 | Fed. Rep. of Germany | 254/286 |
| 972868 | 10/1959 | Fed. Rep. of Germany | 254/338 |
| 1542722 | 9/1968 | France | 254/338 |
| 178580 | 4/1922 | United Kingdom | 254/286 |

*Primary Examiner*—Katherine Matecki

*Attorney, Agent, or Firm*—Schweitzer, Cornman & Gross

[57] ABSTRACT

An apparatus for the motorized control of theatrical sets connected to manual lift units each comprising upper and lower pulleys upon which a line runs to raise and lower a counterweight operatively connected to a set on the stage by a plurality of lift lines is comprised of a series of upper and lower sheaves for support of an independent control line connected to the counterweight. The sheaves are positioned as to not interfere with the manually-operated lines. A drive drum and motor drive unit is associated with each upper and lower sheave, and runs the control line. The drive drums and motor drive units are arranged in a spaced array such that the drive units may be connected and discounted to the drive drums as necessary and required by a particular set configuration, thus eliminating the need for all drums of the array to be coupled to drive units at all times.

7 Claims, 4 Drawing Sheets

STAGE SET LIFT APPARATUS

The present invention relates to the mechanical arts and in particular to an apparatus intended to be utilized in theatrical halls in connection with theatrical productions.

BACKGROUND OF THE INVENTION

The staging of a theatrical production typically requires the creation of a variety of sets to be utilized during the production. As the play progresses and the scenes change, sets must be positioned on and removed from the stage. Depending on the production, the number and size of the sets may be substantial, with a great number of set changes being required.

Typically, the changing of the sets is manual labor performed by a crew of stagehands, utilizing a complex series of lines and pulleys. Banks of lifting lines, normally of wire rope, are located to a side of the stage, out of the sight of the audience, with the lines running vertically to a point high above the stage and then horizontally to other banks of pulleys located above the stage. During preparation for the production, the lines are run to the appropriate over-stage pulleys such that all of the scenery utilized during a production can be positioned on the stage floor as appropriate. The lines are connected to the scenery flats, which are then raised high over the stage, out of view of the audience, to be lowered onto the stage and into the view of the audience as required during the production. To insure that the scenery not in use at a particular time is fully out of view, the over-stage pulleys must be located at an elevation at least twice the proscenium height.

Because of the variable size and often great weight of the sets, the lift line groups for each set are provided with a counterbalance system to offset the set load and to make it easier for the stagehands to raise and lower the sets. The control and operating line for the counterweight is provided with a clamping system which allows the position of the lift lines and the set to which they are affixed to be maintained in position to avoid inadvertent movement.

There have been attempts to replace the manual system outlined above with mechanized and automated set lift systems. Generally, such systems are intended to replace the manual system, and thus require the complete removal of the manual system, with an attendant significant cost. In addition, because the set lift system must allow for locating sets of varying sizes anywhere on the stage, the cost of providing mechanized controllers able to accommodate such variation is substantial. Thus, while the staging of a given production may utilize only a small portion of the available lift capacity, the lift system installed must nevertheless have the ability to handle sets located anywhere across the entire stage area. Much of the installed capacity is accordingly not normally utilized.

It is accordingly a purpose of the present invention to provide a mechanized stage scenery lift apparatus which may be utilized and installed in connection with presently-installed manually-operated scenery lift systems.

Yet another purpose of the present invention is to provide a mechanized scenery lift control system which may be retrofit into existing manual systems without preventing use of the manual system.

Still another purpose of the present invention is to provide such a system which provides for effective and efficient use of the motor drive elements such that it is not necessary that a substantial portion of the motive power available remains unutilized.

BRIEF DESCRIPTION OF THE INVENTION

In furtherance of the above and other objects and purposes, the present invention comprises a series of motorized drive units, each of which is adapted to be connected to and operate a control line assembly which is connected and functions in parallel with the manually-operated control line attached to a set. Each of the control line assemblies include upper and lower sheave blocks positioned so that the line running therebetween is adjacent to, but separate from, the manual control line and the lift lines extending from the counterweight to the set. Each motorized drive unit includes a master drive drum to which the control line is connected, the drive drums for the control line assemblies being located in staggered banks, typically upon a platform located above the stage, and adapted to be connected to a modular motor power unit. Because the power units are of a modular nature, and may be connected to and removed from a drive drum as required, only the drive drums associated with active control line assemblies need be provided with power mechanisms, and it is not necessary for each control line assembly to have a power unit connected thereto at all times. The gearing of the modular power units provide sufficient resistance against undesired movement of the control line and counterweight with which it is associated, so that removal of the power unit from a drive drum frees the motion of the control line assembly to permit the manual operation of the set in the event of system failure or loss of power.

Because the present invention's elements may be retrofit about the manually-operated elements of a stage set lift apparatus, and include an independent control line system, installation of the invention does not require disassembly of the manual system. Accordingly, significant cost economies can be realized upon installation. Further, as the system utilizes modular power units, further cost reductions are recognized by avoiding the necessity for a full compliment of such power units to be on the premises at all times.

BRIEF DESCRIPTION OF THE DRAWINGS

A fuller understanding of the present invention will be achieved upon consideration of the following detailed description of a preferred, but nonetheless illustrative embodiment of the invention when reviewed in association with the annexed drawings, wherein.

Figure 1:
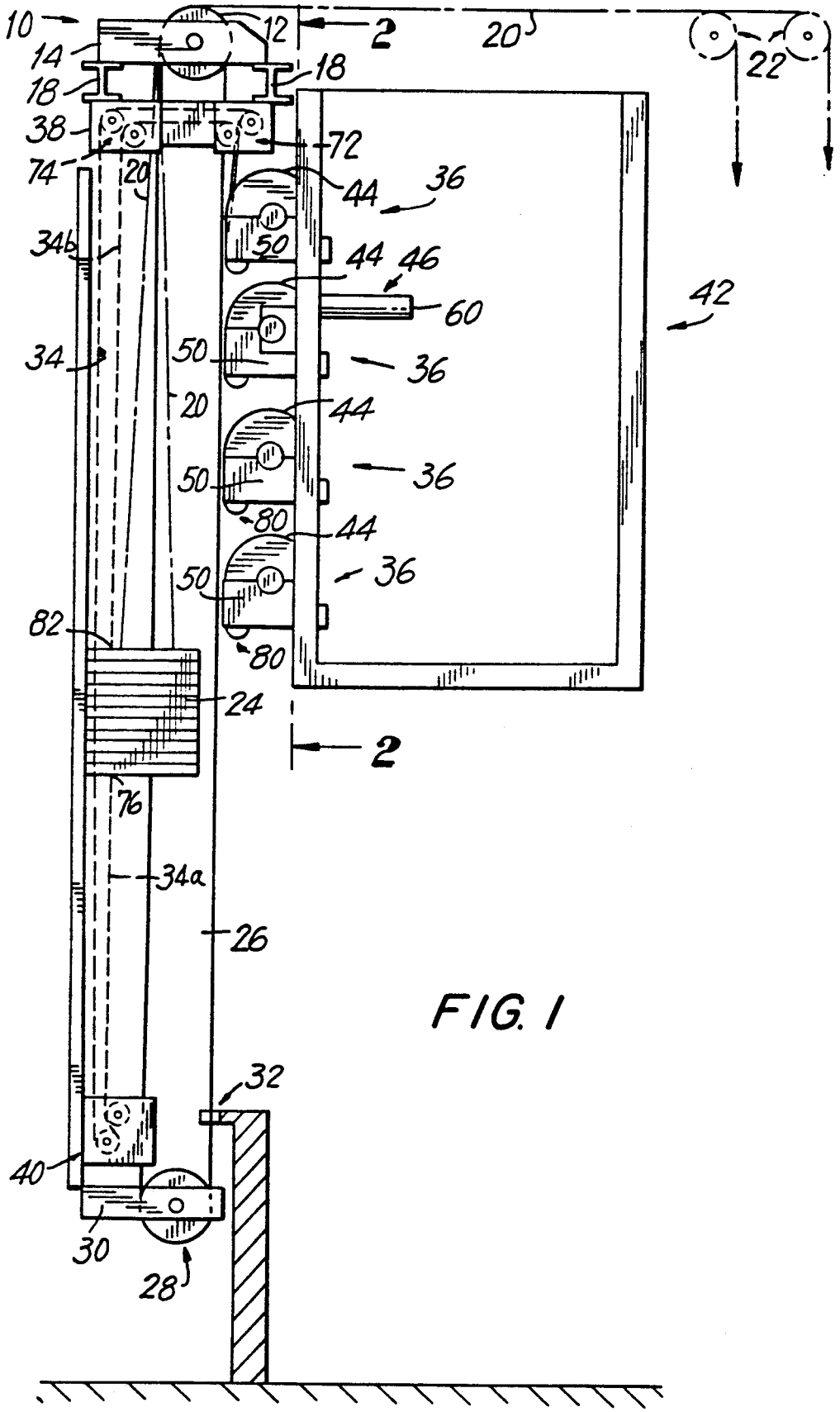
FIG. 1 is a front elevation view of the control system of the present invention installed in conjunction with a conventional, manually-operated scenery lift mechanism located adjacent a side of a theatrical stage.
Figure 3:
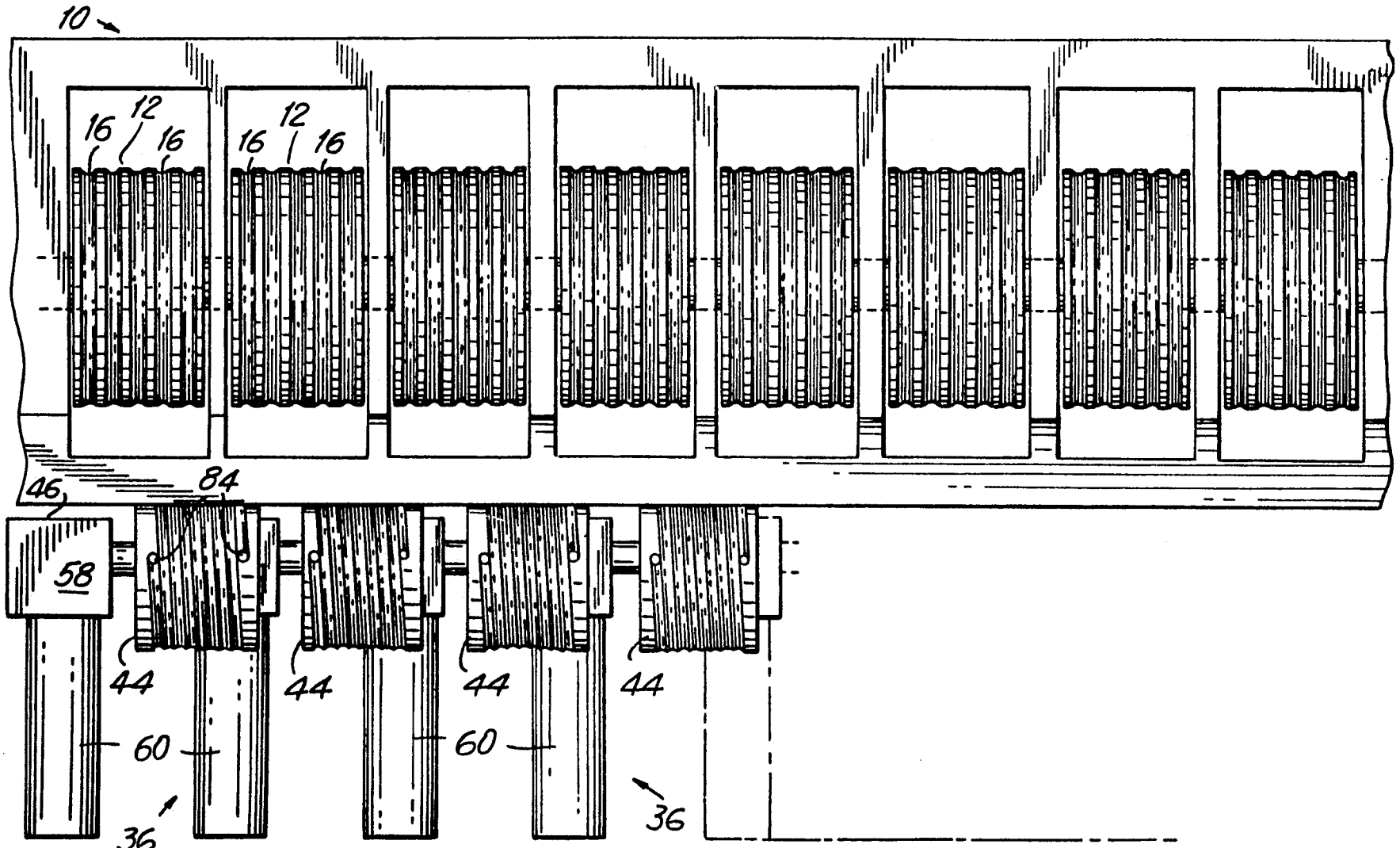
FIG. 3 is a top plan view taken along line 3—3 of FIG. 2, further depicting the relationship between the drive drums and the headblock pulleys utilized for the manual lift line systems.

Referring initially to FIG. 1, a conventional, manually-operated scenery lift apparatus includes a headblock 10, having a plurality of multiple groove pullies 12 each rotatably mounted in the headblock frame 14. The length of the headblock is such that the supported pullies extend over the full depth of the stage. In operation, a pulley 12 is associated with a specific piece of scenery, the specific pulley chosen based upon its position along the depth of the stage, as can be seen in FIG. 3. The multiple grooves 16 in the pulleys 12 allow a plurality of lines to be associated with and connected to the set to allow the set to be raised and lowered safely and evenly. The headblock is typically mounted to a pair of parallel supports, such as I-beams 18, which are an integral part of the stage and theatre construction, and extend the depth of the stage.

The primary scenery lift lines 20 exit the headblock pulley in a horizontal direction, as seen in FIG. 1, traversing the width of the stage high above the stage until engagement with secondary pulley headblocks 22, which direct the lines downward for affixation to the set. The secondary headblocks 22 as shown in FIG. 1 are typically part of a large plurality of such blocks located in an array above the stage to accommodate set lifting wherever on the stage a set is placed. While the headblock 10 is shown with 4-groove pulleys 12, typically such pulleys may be of larger size with a larger number of grooves able to accommodate a larger number of lift lines 20 to support and control large and heavy sets.

The primary lift lines 20, after passing over the headblock 10, and running vertically along a side of the stage, are affixed to a counterweight 24, typically a series of removable weight units installed on an arbor which travels vertically and counterbalances the weight of the set to which the lines 20 are affixed. The counterweight 24 is also provided with a control line 26, which runs in a loop vertically between the appropriate pulley 12 of headblock 10 and a lower pulley block 28 mounted to a lower frame element 30. Manual operation of control line 26 thus raises and lowers the associated counterweight 24, which in turn allows the set associated with the counterweight to be raised and lowered. A rope lock 32, shown schematically in FIG. 1, allows a clamping tension to be placed against the control line 26, thus preventing movement of the counterweight and fixing the associated set in position. During the course of a performance, stagehands are positioned at the bank of the control lines, and operate the lines as required to raise and lower the sets in accordance with the schedule of presentation.

During set up of the scenery, each set to be utilized is rigged to the appropriate lift lines, which are connected to an empty counterweight arbor. The set is manually raised, by an auxiliary line or the like, as weights are placed upon the counterweight arbor until an equilibrium with the set is established. Upon confirmation by a designated member of the crew, the set is deemed in proper balance and the auxiliary line is removed.

In conjunction with this known structure, the present invention utilizes a second, independent control line 34 for counterweight 24, driven by a motorized drive unit 36 to provide automated control over set positioning. The invention is complimentary to the operation of the manual system, such that the manual system may be utilized when required.

Depicted in place with the manual unit in FIG. 1, a drive unit 36 drives the control line 34 which is connected to the counterweight 24, and which is supported at its upper extent by an upper sheave unit 38 and at its lower extent by a lower sheave unit 40. The ends of the line are affixed to the counterweight 24. As each counterweight is provided with a separate automated drive system, each scenery set is individually controllable.

The elements of the invention are so located and positioned as to permit the unimpeded operation of the manual system as may be desired or necessary. Thus, an aspect of the present invention includes the orientation of the control line assemblies and drive units such that they both perform in the proper manner and do not conflict with the manual system elements. In this regard, and with reference to FIG. 2, it may be seen that upper sheaves 38 are mounted to the lower surfaces of I-beams 18 on which the headblocks 10 are mounted, offset from the headblock pulleys 12 such that the lines 34 connected to the sheaves' pulleys do not interfere with the lines 20 and 26 which are carried by the headblock pulleys 12.

Figure 2:
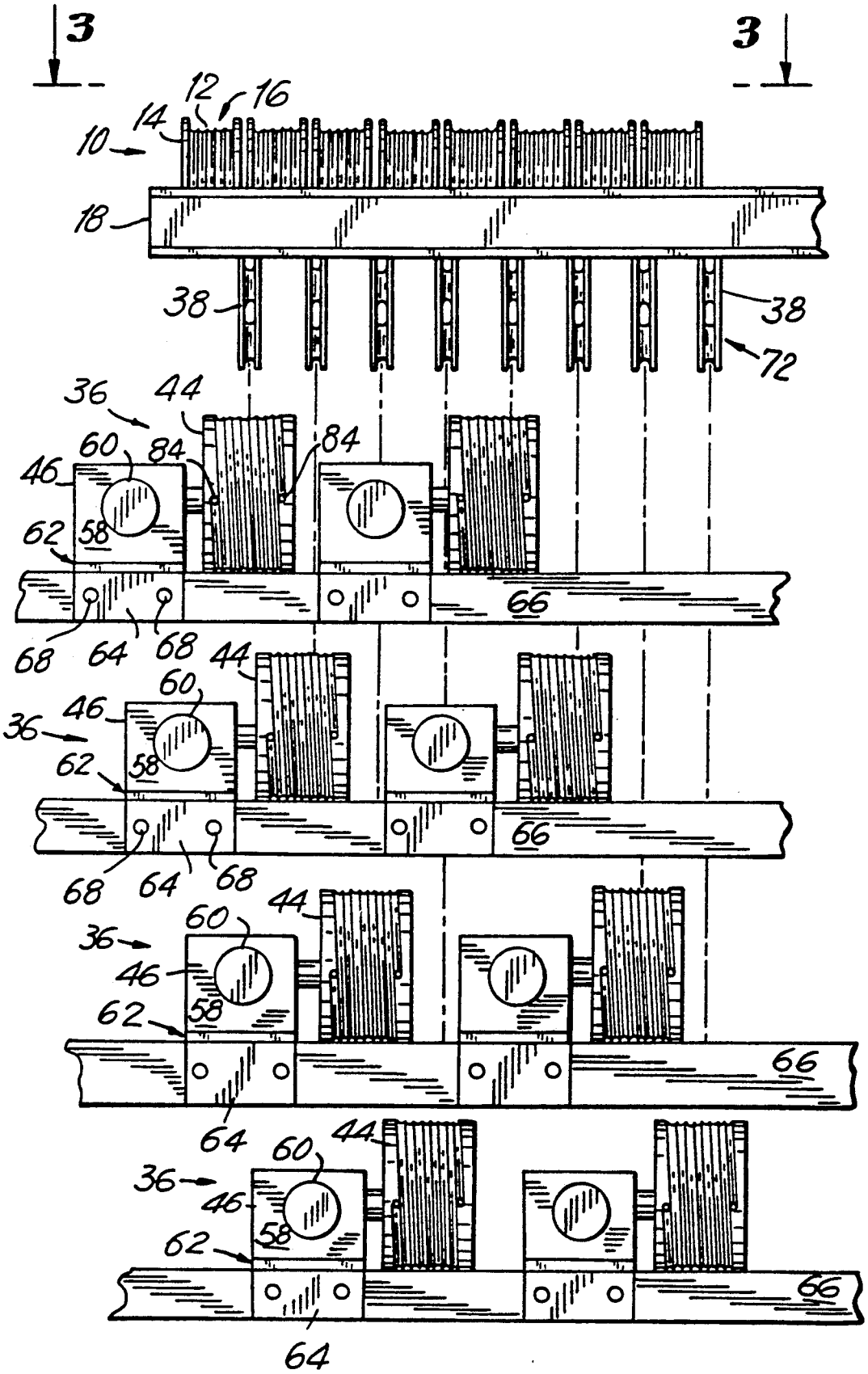
FIG. 2 is a side elevation view taken along line 2—2 of FIG. 1, detailing the staggered arrangement of the drive drums and modular drive motor units with respect to the upper sheave blocks of the invention.

Each upper sheave 38 has associated with it drive unit 36 which, as may be best seen in FIG. 2, is arranged as part of a multiple-level array. Typically, the drive units may be located in an open control frame or bridge 42 adapted for access by operating personnel and which may be positioned above the stage, out of sight of the audience. In a preferred embodiment, the bridge may be positioned adjacent the raised loading bridge utilized by personnel for counterweight loading. The drive units 36 themselves each comprise a helically-grooved drive drum 44, coupled to a motorized power unit 46.

Figure 4:
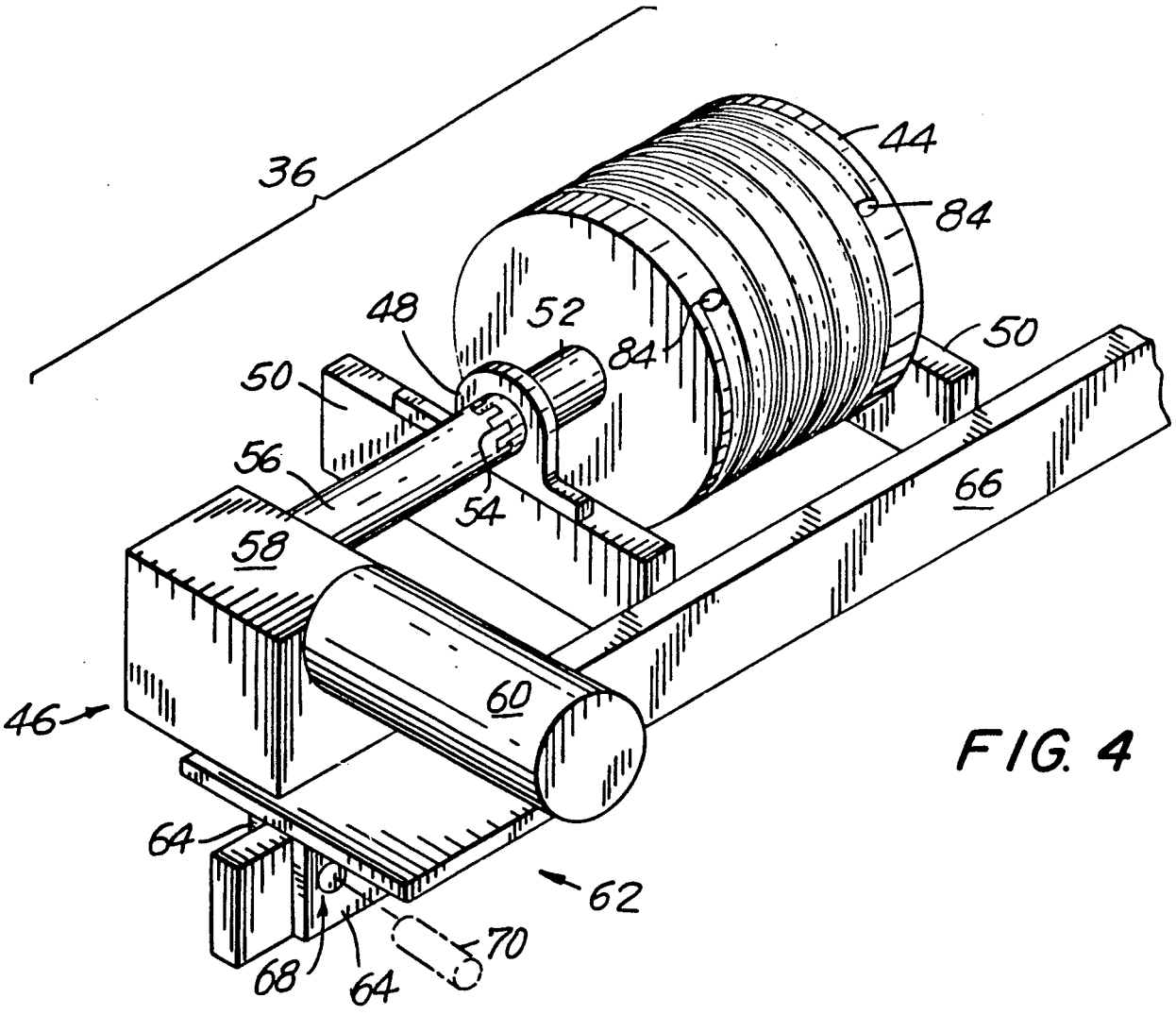
FIG. 4 is a perspective view of a modular drive unit engaged with a drive drum.

As may be seen in FIG. 4, the drum 44 is journaled in pillow blocks 48 mounted to support brackets 50 which extend outwardly from a side of the bridge 42. The drum shaft 52 is provided with a splined entryway which accepts the similarly splined end 54 of drive shaft 56 extending from the gearbox 58. An appropriate drive motor 60, which may include appropriate sensor, positioning and feedback systems, is mounted to the gearbox to provide the motive power. As known in the art, the drive motor 60 may be driven and controlled by appropriate electronic circuitry, including microprocessor circuits, which allow for the precise drive and hence positioning of the sets to which the control unit is connected. As may be desired or required, proportional speed control may be utilized in conjunction with the positioning action. Because the counterweight and set are in equilibrium, the motor 60 need only supply enough power to overcome frictional and inertial effects, and thus can be of a relatively low horsepower, thus achieving substantial cost savings over horsepower requirements for a non-counterweighted system.

The drive motor and gearbox combination are themselves mounted to a motor bracket 62 which may advantageously include a pair of depending legs 64 which embrace and support the bracket upon the horizontally-extending bridge rail 66. Because of the staggered arrangement of the drums 44 upon a plurality of the bridge rails 66 as seen in FIG. 2, horizontal spacing is provided between the drive units 36 sufficient to allow the motor brackets to be slid along the bridge rail 66 between engaged and disengaged positions between the mating portions of gearbox shaft 56 and drum shaft 52. One or more transverse bores 68 are provided through the bracket legs 64, which bores align with complimentary bores in the rail when the shafts are in the fully-engaged position. A pin 70 is provided to lock the motor bracket in the engaged position. It is to be appreciated that a given power unit 46 may be placed upon and removed from a mounting rail 66 as required, thus eliminating the necessity for a full compliment of power units to be available and associated with each and every drum and associated lift assembly.

As best seen in FIG. 1, the upper sheave assembly 38 includes front and rear pairs of pulleys 72, 74 respectively, located at opposed ends of the assembly. The length of the sheave assembly 38 is chosen such that the pulley pairs are each located beyond the area occupied by the manual control line 26 and the lift lines 20 running to the sets, so as to not interfere with manual operation or the motion of those elements.

In a preferred embodiment of the invention the control line 34 may be composed of two independent line segments, 34*a* and 34*b*. A first end 76 of the line 39 is affixed to the counterweight 24, the line running downwardly to lower sheave unit 40, which allows the line to reverse direction and directs it to the upper sheave 38. The line then passes over one of the rear pair of pulleys 74 and then over one of the front pair 72, whereby it is then directed downwardly to the associated drive drum 44 aligned with the sheave.

As may be seen in FIG. 2, the drum is provided with a pair of retaining bores 84 at the opposed ends of the helical groove. The line 34*b* is wrapped about the drum, its end being affixed thereto by insertion through the appropriate bore where it is clamped or tied off to the drum. An end of the second line 34*a* is affixed to the drum through the second bore 84. The line is wrapped about the drum for several turns, and exists the drum downwardly, whereby its travel is reversed by depending idler pulley 80, seen in FIG. 1, appropriately mounted to the lower portion of the support bracket 48. The line is then directed across the second pulleys in the pulley pairs 72 and 74 in sheave 38, exiting the rear end of the sheave downwardly to connect at its second end 82 with the counterweight 24. A closed loop is thus created, whereby appropriate rotation of grooved drum 44 drives the counterweight 24 upwardly or downwardly, the set to which the counterweight is affixed through lines 20, being positioned as required. It is to be recognized that, as the counterweight is raised or lowered, one of the lines 34*a,b* will be wound onto the drum 44 while the other of the lines is being led off. General safety considerations call for several loops of line to remain on the drum at all times, so the size of the drum and the number of revolutions of helical grooves are chosen to allow sufficient turns of the lines to remain at both the upper and lower limits of counterweight travel.

It thus may be seen that the present invention permits the mechanization and automation of manually-operated stage scenery equipment without the necessity for removal of presently-existing apparatus or compromising the manual operation aspects. The locating and positioning of the elements of the present invention allow such mechanization to be accomplished in an economical fashion, while the utilization of interchangeable drive elements, which are separable from the drive pulleys and are located in a staggered orientation, permit economies of usage to be developed and allow the interchange of drive elements to provide for efficient operation. While the invention has needs described in the form of a presently preferred embodiment, it is to be recognized by those skilled in the art that modifications and adaptations to the invention as disclosed may be achieved without departing from the spirit or scope of the invention as set forth in the annexed claims.

We claim:

1. Apparatus for the motorized control of a theatrical set or the like connected to a manual lift unit comprising upper and lower pulley blocks upon which a loop line runs to raise and lower a counterweight to which the ends of said loop line are affixed, said counterweight being operatively connected to a set on a stage by a plurality of lift lines connected to said counterweight and directed over said upper pulley block, over the stage and downward to said set, the motion of said loop line controlling the raising and lowering of the set, said apparatus comprising: an upper sheave mounted adjacent to the upper pulley block; a lower sheave mounted proximate said lower pulley block, said upper and lower sheaves being further positioned in a non-interference relationship to said pulley blocks and the lines associated therewith; a drive drum; a motor unit selectively connectable to and removable from said drive drum; and a motor control line, the ends thereof being connected to the counterweight, said motor control line forming a closed loop from said counterweight to said lower sheave, to said upper sheave, to said drive drum, to said upper sheave and returning to said counterweight.

2. The apparatus of claim 1, wherein said upper sheave comprises first and second pulley sets, said first pulley set being located on a first side of said lift lines and said second pulley set being located on a second side, said first and second sets directing said motor control line across the space occupied by said lift lines in a non-interfering manner.

3. The apparatus of claim 2, wherein said drive drum comprises a drum having a helical line-accepting groove on the surface thereof, said drum being mounted on a shaft having a splined entryway; said drive units having a complementary splined shaft to engage said drum shaft.

4. The apparatus of claim 3, wherein said motor unit comprises a drive motor and a gear box mounted to a support frame, said drive drum being mounted to a support rail, said drive motor support frame being adapted to be horizontally, slideably mountable on said rail.

5. The apparatus of claim 4, wherein said drive drum unit further includes an idler pulley mounted and adapted to reverse the direction of said line as it leaves said drum.

6. The apparatus of claim 3, wherein said motor control line comprises a pair of line segments, each of said line segments having a front end connected to said counterweight and a second end connected to said drum.

7. The apparatus of claim 6, wherein said first line segment runs from said counterweight to said upper sheave to said drum and said second line segment runs from said counterweight to said lower sheave, to said upper sheave, to said drum.

* * * * *